United States Patent [19]

Abe

[11] 4,063,500

[45] Dec. 20, 1977

[54] ROTARY HOT-STAMPING APPARATUS

[75] Inventor: Moriaki Abe, Tokyo, Japan

[73] Assignee: E.D.M. Co., Ltd., Tokyo, Japan

[21] Appl. No.: 714,660

[22] Filed: Aug. 16, 1976

[30] Foreign Application Priority Data

Sept. 25, 1975 Japan ..... 50-131311[U]

[51] Int. Cl.[2] ..... B44B 5/00

[52] U.S. Cl. ..... 101/25; 101/336; 197/151; 101/27

[58] Field of Search ..... 101/5, 6, 8, 22–25, 101/27, 336, 228; 197/151

[56] References Cited

U.S. PATENT DOCUMENTS

| | | | |
|---|---|---|---|
| 1,978,073 | 10/1934 | Belcher | 101/228 |
| 2,039,236 | 4/1936 | Meisel | 101/228 |
| 2,321,426 | 6/1943 | Rouan et al. | 101/228 |
| 2,756,669 | 7/1956 | Hoffman | 101/25 |
| 3,146,698 | 9/1964 | Worth | 101/25 |
| 3,162,290 | 12/1964 | Knight | 101/336 X |
| 3,837,462 | 9/1974 | Patel et al. | 197/151 |

*Primary Examiner*—Edward M. Coven
*Attorney, Agent, or Firm*—George B. Oujevolk

[57] ABSTRACT

For imprinting characters on a continuous strip of plastics or other material by pressing heated type against a printing ribbon thereon, the strip is fed at constant speed over a platen in a direction opposite to the direction of travel of the printing ribbon from payoff reel to takeup reel. The type is mounted on a rotary type carrier over the platen, for revolution in a direction in conformity with the traveling direction of the strip. While the heated type is being pressed against the superposed ribbon and strip over the platen, the ribbon is thereby transported a predetermined distance toward the payoff reel with the strip relative to the platen and, when subsequently released by the type, is pulled back the same distance toward the takeup reel by a spring-energized pullback lever. The ribbon is then wound up onto the takeup reel via a pair of drawoff rollers just by a length corresponding to the width of the character or characters on the typeface.

4 Claims, 4 Drawing Figures

ROTARY HOT-STAMPING APPARATUS

BACKGROUND OF THE INVENTION

My invention relates to the art of hot stamping, also known as hot-press printing, and is more specifically directed to a method of, and apparatus for, repeatedly imprinting characters on a continuous strip of plastics, paper or other material by pressing heated type against a printing ribbon placed in superposition on the strip.

A well known form of the printing ribbon used with hot stamping apparatus of the kind under consideration comprises the laminated layers of plastics or like backup material, parting or releasing material, metal, and adhesive. As heated type is pressed against the ribbon upon a desired surface, the metal layer is transferred and attached to the surface via the adhesive in the exact shape of the relief character or characters on the typeface. In another known form of printing ribbon, the aforesaid layers of metal and adhesive are replaced by a single layer of mixed pigment and adhesive.

For repeatedly imprinting characters on a continuous strip of plastics or like material by use of such printing ribbon, there has been suggested a rotary hot-stamping machine wherein the strip is fed at constant speed over a cylindrical platen in the same direction as the direction of travel of the printing ribbon from payoff reel to takeup reel (Japanese Patent Publication No. 49-14891). Type is mounted on a rotary type carrier over the platen so as to be pressed against the printing ribbon placed in superposition on the strip passing over the platen.

The operation of this prior art hot stamping machine is such that, while being pressed by the heated type, the ribbon is thereby transported a predetermined distance, which is considerably in excess of the width of the character or characters on the typeface, with the strip toward the takeup reel. This takeup reel is then actuated to wind up the ribbon by a length corresponding to the width of the character on the typeface. Further, when released by the type, the ribbon is fed back toward the payoff reel by reciprocating pullback means, only to such an extent that the type will be subsequently pressed against the ribbon at a region immediately adjoining its previously used region. The pullback means further operates to draw the ribbon from the payoff reel by a length corresponding to the width of the character.

The hot stamping machine according to the mentioned Japanese patent has the advantages of high speed operation and wasteless use of the printing ribbon, but is not free from some shortcomings. For proper operation of the machine, a braking force must be applied to the payoff reel to arest its rotation while the ribbon is being pulled back toward same. This braking force must be greater than the force of the pullback means required to detach the ribbon from the strip of desired material and to pull back the ribbon the required distance toward the payoff reel. If the braking force were too great, however, the pullback means would be unable to draw the ribbon from the payoff reel. The magnitude of the braking force on the payoff reel is therefore in need of fine adjustment.

An even more serious problem arises as the printing operation proceeds, with the gradual decrease in the radius of the roll of the printing ribbon on the paypoff reel, because then a correspondingly increasing force is required for unwinding the ribbon. Since the force of the pullback means is usually constant, the magnitude of the braking force on the payoff reel must be decreased in step with the decrease in the radius of the ribbon roll thereon. If the braking force is not properly regulated as above and becomes too great or too small in relation to the force of the pullback means, the machine will become inoperable.

SUMMARY OF THE INVENTION

It is an object of my invention to provide an improved method of imprinting characters on a continuous strip of desired material at constant spacings by repeatedly pressing heated type against a printing ribbon thereon, such that the above noted problems of the prior art can be thoroughly overcome without impairing the advantages of high speed operation and wasteless use of the printing ribbon.

Another object of my invention is to provide hot stamping apparatus which is believed to be of optimum construction for carrying the above specified method into effect.

A further object of my invention is to provide hot stamping apparatus which requires a minimum of, and extremely simple, adjustments for proper operation and which has the minimum possibility of giving rise to trouble.

A further object of my invention is to provide hot stamping apparatus capable of winding up, after each time the heated type is pressed against the printing ribbon on the strip of material, just a length of the ribbon corresponding to the width of the character or characters on the typeface, for economical use of the ribbon which is rather expensive.

A still further object of my invention is to provide hot stamping apparatus capable of neatly accumulating the used printing ribbon upon a takeup reel, without twisting the ribbon in so doing.

Briefly, my invention is best characterized by the fact that the printing ribbon travels from payoff reel to takeup reel in a direction opposite to the direction of travel of a continuous strip of desired material to be printed on, which strip is fed at constant speed over a platen. Type is mounted on a rotary type carrier having a built-in heater, so as to be pressed against the ribbon which is placed in superposition on the strip over the platen on its way payoff reel to takeup reel. While the heated type is being pressed against the superposed ribbon and strip over the platen, the ribbon is allowed to be transported thereby a predetermined distance toward the payoff reel and, when subsequently released by the type, is pulled back the same distance toward the takeup reel, while the strip continues traveling in its predetermined direction. The takeup reel is then actuated to wind up just a length of the ribbon corresponding to the width of the character or characters on the typeface. By the repetition of the foregoing cycle of operation, the character or characters are imprinted on the strip at constant spacings.

The above and other objects, features and advantages of my invention and the manner of attaining them will become more apparent, and the invention itself will best be understood, upon consideration of the following description taken in connection with the accompanying drawings showing a preferred embodiment of the invention.

DESCRIPTION OF THE PREFERRED EMBODIMENT

A preferred form of my improved hot stamping apparatus will now be described with reference to the accompanying drawings. The method according to my invention will best be understood from the description of the operation of the preferred apparatus embodiment, which is to follow the description of its construction.

Figure 1:
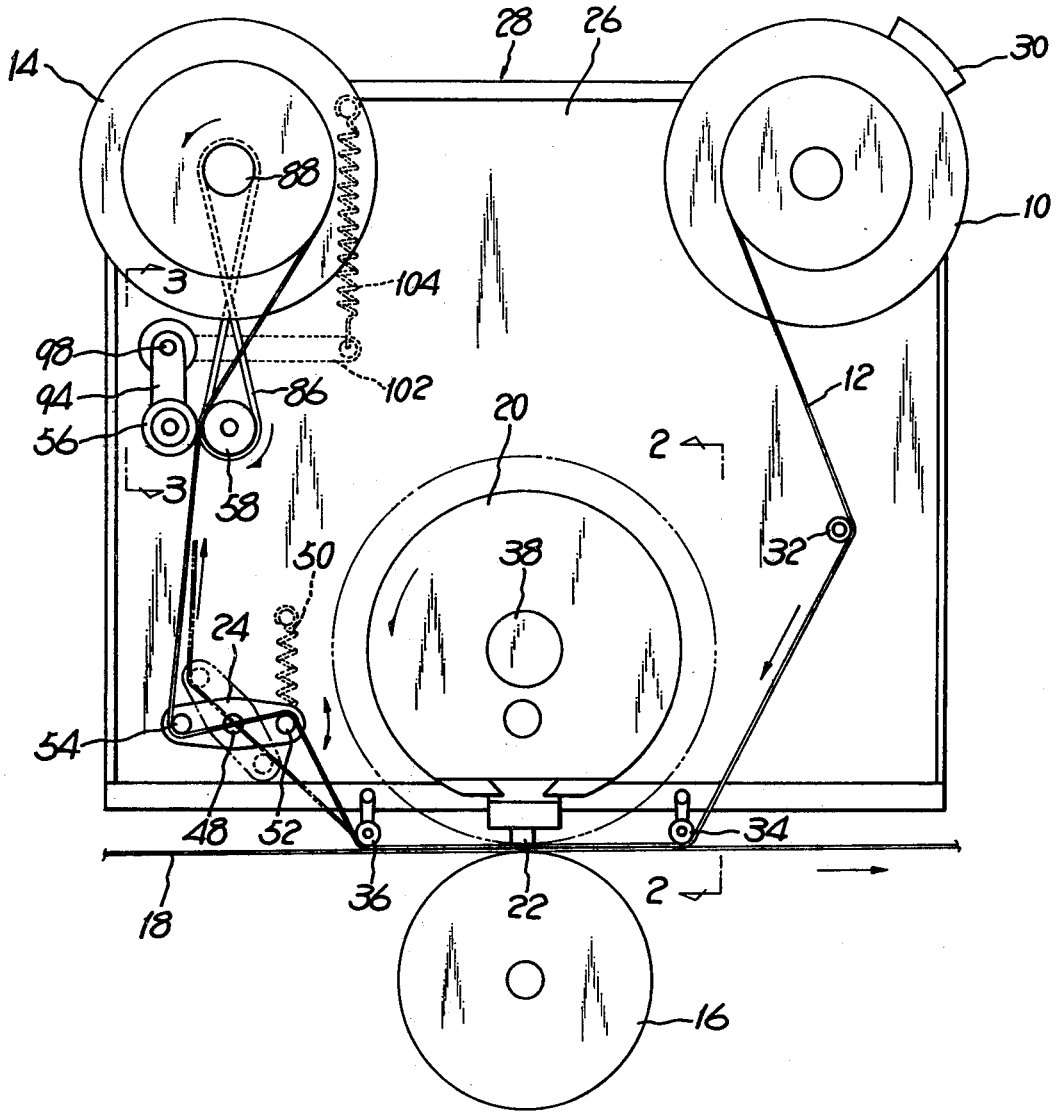
FIG. 1 is a front elevational view of hot stamping apparatus constructed in accordance with the principles of my invention.

As shown in FIG. 1, the hot stamping apparatus broadly comprises a payoff reel 10 from which a printing ribbon 12 of any known or suitable type is fed, a takeup reel 14 for winding up successive desired lengths of the printing ribbon, a platen 16 which is shown as a rotary cylinder and over which passes a strip of plastics or other material 18 to be printed on, a type carrier 20 carrying type 22 for pressing same against the printing ribbon for imprinting characters on the strip of material passing over the platen, and a pullback lever 24 for yieldably holding an extra length of the printing ribbon between the platen and the takeup reel.

Of the above listed parts, the payoff reel 10, takeup reel 14 and type carrier 20 are rotatably mounted on the front panel 26 of a boxlike casing 28 in which are accommodated the drive means for the type carrier and various other parts of the apparatus hereinafter described. The axes of rotation of these payoff reel, takeup reel and type carrier are all arranged in parallel relationship to each other.

The platen 16 is suitably mounted under the type carrier 20 so as to be free to rotate about an axis parallel to, and in vertical register with, the rotational axis of the type carrier. During operation of the apparatus the strip of material 18 is to be fed from left to right, as seen in the drawing, over the platen 16 at constant speed by means which are not shown because of their conventional nature.

The payoff reel 10 is shown to have a brake 30 for applying a constant, practically minimum braking force thereto. This brake is intended merely to prevent the printing ribbon 12 from loosening as it is unwound from the payoff reel. No great or variable braking force is required for retarding the rotation of the payoff reel according to my invention, as will be more fully understood as the description proceeds.

For guiding the printing ribbon 12 as it travels from the payoff reel 10 to the takeup reel 14, generally in a direction opposite to the direction of travel of the strip of material 18 over the platen 16, three guide rollers 32, 34 and 36 are mounted on the casing 28. Of these the guide rollers 34 and 36 are intended to place the printing ribbon in superposition on the strip of material as the ribbon passes between platen 16 and type carrier 20.

In order to press the thus superposed ribbon 12 and strip 18 against the platen 16, the type 22 is fixedly but replaceably mounted on the type carrier 20 is shown to be cylindrical in shape. This type carrier has a built-in heater, not shown, for heating the type in accordance with the prior art. The type 22 has a relief character, or usually a set of relief characters, formed on its face for direct contact with the printing ribbon on the strip of material, so that the metal layer, for example, in the ribbon may be transferred to and imprinted on the strip in the exact shape of the relief character or characters on the typeface, as has been known heretofore.

Figure 2:
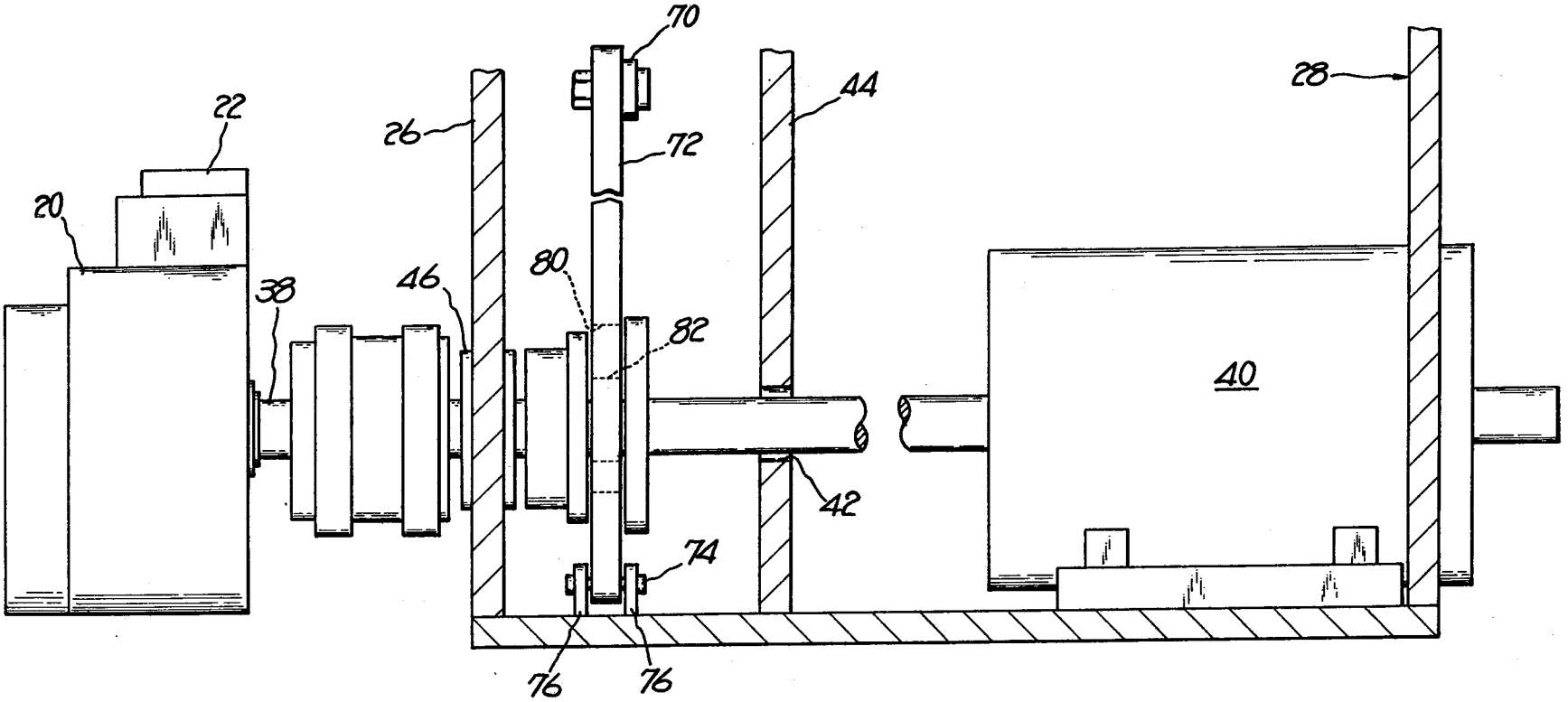
FIG. 2 is an enlarged, fragmentary sectional view taken along the line 2—2 of FIG. 1.

With reference to FIG. 2, the type carrier 20 is fixedly mounted on the output shaft 38 of an electric motor drive unit 40, preferably of the adjustable speed type, mounted within the casing 28. The motor shaft 38 extends with clearance through a hole 42 in a wall 44 within the casing 28 and is rotatably supported by a bearing 46 mounted on its front panel 26. The type carrier 20 with the type 22 thereon is maintained in constant rotation in a predetermined direction, counterclockwise as viewed in FIG. 1, during operation of the apparatus. For making clear-cut imprints, the angular speed of the type 22 on the type carrier should be synchronized, as far as possible, with the linear speed at which the strip of material 18 is fed past the platen 16. The output torque of the motor drive unit 40 can of course be utilized for thus feeding the strip past the platen.

Referring again to FIG. 1, the platen 16 should be made of suitably resilient, heat-resisting material such as, for example, a silicone rubber. Some resiliency of the platen is desirable to afford closer contact between printing ribbon 12 and strip of material 18 as the former is urged against the latter over the platen by the type 22.

Thus, while the type 22 on the rotating type carrier 20 is being pressed each time against the printing ribbon 12 on the strip of material 18 over the platen 16, the ribbon is thereby transported a predetermined distance in the reverse direction, that is, in the same direction as the strip, relative to the platen. The pullback lever 24 is designed to permit such reversed travel of the printing ribbon without necessitating the reversed rotation of the takeup reel 14 and, when the ribbon is subsequently released by the type, to pull back the ribbon the same distance toward the takeup reel relative to the platen.

For performing the above functions, the pullback lever 24 is pivotally supported at a point intermediate both ends thereof by a pin 48 mounted on the front panel 26 of the casing. A relatively light tension spring 50 biases the pullback lever 24 to turn counterclockwise, as viewed in FIG. 1, about the pivot pin 48. The counterclockwise turn of this pullback lever is limited by a stop, not shown, so that the lever is normally held in the angular position depicted by the solid lines in FIG. 1. The pullback lever has a pair of rollers 52 and 54 rotatably mounted on its opposite ends, and the printing ribbon 12 is threaded over the right hand roller 52 and under the left hand roller 54, on its way from the platen 16 to the takeup reel 14.

Normally, therefore, the printing ribbon 12 is maintained in a zigzag pattern between the platen 16 and the takeup reel 14. As the ribbon is transported the predetermined distance in the reverse direction as aforesaid, the pullback lever 24 is turned clockwise against the bias of the spring 50 to the angular position indicated by the dot-and-dash lines in FIG. 1, thereby permitting the required extra length of the printing ribbon to be fed back toward or past the platen.

When the printing ribbon 12 is subsequently released by the type 22 upon completion of imprinting the character or characters thereon, tthe pullback lever 24 is turned back to its normal angular position under the bias of the spring 50. The printing ribbon can therefore be returned the same distance past the platen 16 toward the takeup reel 14.

The used printing ribbon 12 may be wound up directly onto the takeup reel 14 as it passes the pullback lever 24. For the best results, however, a cooperative pair of drawoff rollers 56 and 58 should be interposed between pullback lever and takeup reel. Urged against each other via the printing ribbon 12 passing therebetween, these drawoff rollers are to be intermittently actuated for feeding toward the takeup reel just a length of the printing ribbon corresponding to the width of the character or characters on the face of the type 22 after each time the imprint or imprints have been made on the strip of material 18. The takeup reel 14 is actuated simultaneously with the drawoff rollers for winding up the required length of the printing ribbon.

Figure 4:
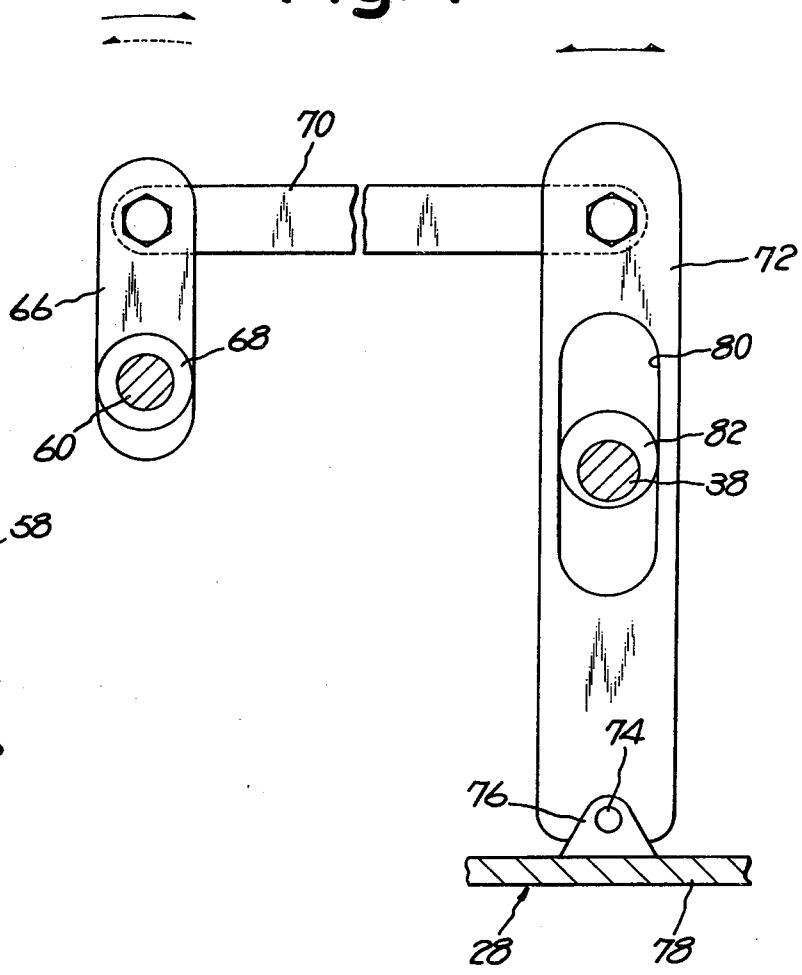
FIG. 4 is an enlarged front elevational view of means for actuating drawoff rollers in the apparatus of FIG. 1.
Figure 3:
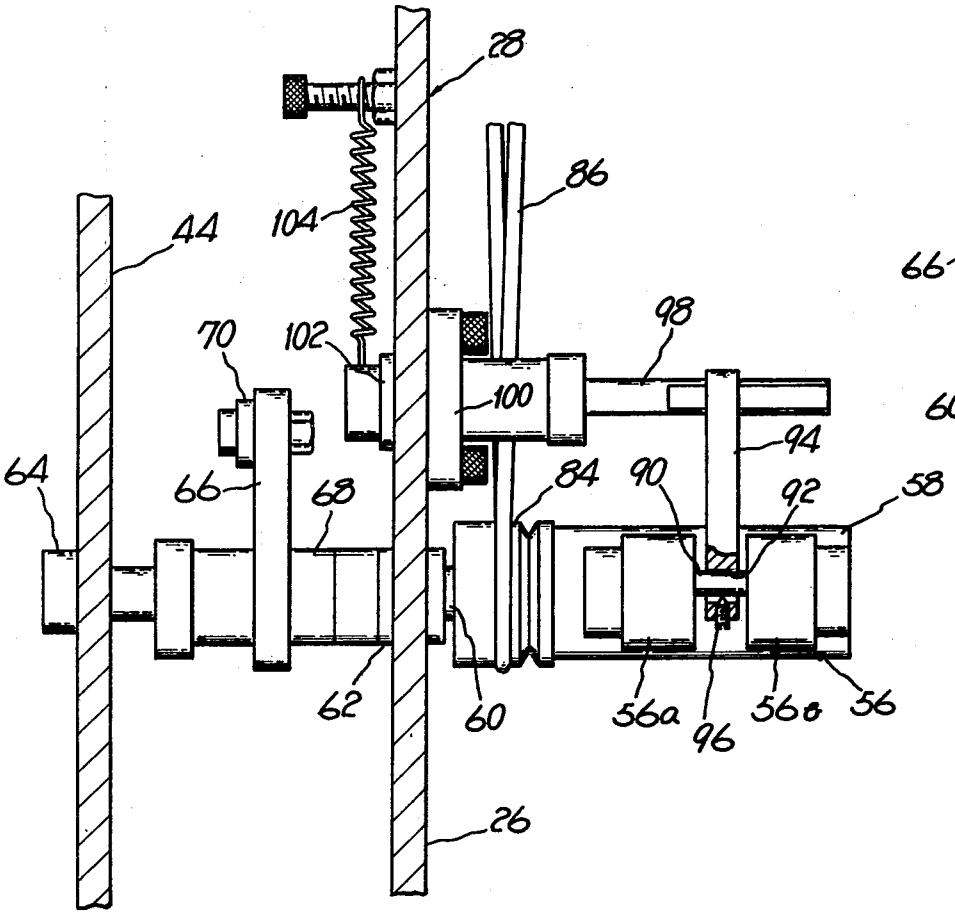
FIG. 3 is an enlarged, fragmentary sectional view taken along the line 3—3 of FIG. 1.

FIGS. 3 and 4 best illustrate the means for actuating the drawoff rollers 56 and 58, as well as the takeup reel 14, in the above described manner. It will be observed from FIG. 3 that the drawoff roller 56 is transversely divided into a pair of axially spaced halves **56*a* and 56*b*, for purposes hereinafter made apparent, whereas the other drawoff roller 58 is of unitary construction. The desired actuating force is imparted directly to this unitary drawoff roller 58, the other roller 56** being frictionally rotated simultaneously therewith.

The unitary drawoff roller 58 is fixedly mounted on a rotatable shaft 60 for rotation about an axis parallel to the axis of the takeup reel 14 and so forth. The drawoff roller shaft 60 is journaled in a bearing 62 mounted on the front panel 26 of the casing 28 and in another bearing 64 mounted on the wall 44 within the casing. Between front panel 26 and wall 44, a lever 66 is mounted on the drawoff roller shaft 60 via a one-way clutch 68 of any known or suitable construction which is intended for functions described later.

With particular reference to FIG. 4, a link 70 is pivotally connected at one end to the free end of the lever 66 and at another end to one end of a cam follower lever 72. This cam follower lever has its other end pivotally pinned at 74 to a pair of lugs 76 mounted on the bottom 78 of the casing 28, as will be seen also from FIG. 2. A slot 80 is formed longitudinally of the cam follower lever 72 for somewhat loosely or slidably receiving a cam 82 fixedly and eccentrically mounted on the aforesaid shaft 38 transmitting the rotation of the motor drive unit 40 to the type carrier 20.

Since the type carrier shaft 38 is in constant rotation during operation of the apparatus, the rotation of the cam 82 thereon causes the cam follower lever 72 to turn reciprocally about the pivot pin 74, as indicated by the double-headed arrow in FIG. 4. The reciprocal motion of the free end of this cam follower lever is transmitted to the one-way clutch 68 via the link 70 and the lever 66. The one-way clutch functions to permit rotation of the drawoff roller shaft 60 only when the lever 66 is turned clockwise about the shaft, as indicated by the solid arrow in FIG. 4, and to hold the drawoff roller shaft stationary when the lever is pivoted counterclockwise, as indicated by the dotted arrow in the same drawing.

It is possible in this manner to intermittently rotate the unitary drawoff roller 58 through a predetermined angle corresponding to the width of the character or characters on the face of the type 22. Such intermittent rotation of the unitary drawoff roller takes place, of course, while the type 22 on the rotating type carrier 20 is out of contact with the printing ribbon 12 over the platen 16.

FIG. 3 also illustrates a pulley 84 securely mounted on the drawoff roller shaft 60. An endless belt 86 extends around this pulley and another pulley, not shown, on a rotatable shaft 88, FIG. 1, on which is mounted the takeup reel 14. It will be noted from FIG. 1 that the endless belt 86 extends crosswise between the pair of pulleys. Each time the drawoff roller 58 is rotated clockwise through the predetermined angle, therefore, the takeup reel 14 is rotated counterclockwise through a corresponding angle for winding up the required length of the printing ribbon 12 that has been fed frictionally past the pair of drawoff rollers 56 and 58.

With reference again to FIG. 3, the pair of drawoff roller halves **56*a* and 56*b* are rotatably mounted on opposite ends of a spindle or short shaft 90 extending with substantial clearance through a hole 92 at or adjacent the bottom end of a pivotal support arm 94, the hole 92 extending through the support arm in a direction parallel to the rotational axis of the unitary drawoff roller 58. The drawoff roller halves 56*a* and 56*b* are thus disposed on opposite sides of the support arm 94**.

For connection of the spindle 90 to the support arm 94, there is employed a set screw 96 which is shown to be of the type cone-pointed at one end and slotted at the other. The set screw 96 is driven into the support arm 94 upwardly from its bottom end so that the spindle 90 may pivotally rest on the cone-pointed end of the screw at a midpoint between the pair of drawoff roller halves **56*a* and 56*b*. The spindle 90 is therefore pivotable within relatively narrow limits about its midpoint relative to the support arm 94 in a plane containing the rotational axis of the unitary drawoff roller 58, so that the drawoff roller halves 56*a* and 56*b*** have some play in that plane.

As will be seen also from FIG. 1, the support arm 94 has its top end rigidly connected to one end of a rotatable shaft 98 journaled in a bearing 100 mounted on the front panel 26 of the casing 28. The other end of the shaft 98, projecting inwardly of the front panel 26, is rigidly connected to a lever 102.

A relatively heavy tension spring 104 is connected to the free end of the lever 102 for urging the drawoff roller halves **56*a* and 56*b* against the unitary drawoff roller 58 under sufficient pressure to hold the printing ribbon 12 positively frictionally arrested therebetween when the ribbon is being transported by the type 22 in the same direction as the strip of material 18 relative to the platen 16 in opposition to the force of the pullback lever spring 50. It should be appreciated that, in the hot stamping apparatus according to my invention, no trouble arises if the force of the drawoff roller spring is excessively greater than that of the pullback lever spring 50**.

Since the spindle 90 on which the pair of drawoff roller halves **56*a* and 56*b* are rotatably mounted is pivoted on the pointed end of the set screw 96, these roller halves can be urged under equal pressure against the unitary drawoff roller 58 via the printing ribbon 12 extending therebetween. The printing ribbon can therefore be neatly accumulated on the takeup reel 14 as the ribbon is fed toward the reel by the drawoff rollers 56 and 58**.

The foregoing construction of the drawoff roller 56 is essential or at least desirable because the printing ribbon for use with the hot stamping apparatus of this type is as wide as, for example, 25 millimeters. If the drawoff roller 56 were also of unitary construction, it would be highly difficult to urge the roller against the other drawoff roller 58 under equal pressure throughout their elongate axial dimension, and the printing ribbon passing therebetween would be easily twisted.

Preferably, the drawoff roller halves 56*a* and 56*b* should be made of hard rubber or like material, and the unitary drawoff roller 58 should be suitably knurled. The printing ribbon 12 will then be even more positively caught frictionally therebetween.

What follows is the description of the operation of this hot stamping apparatus, which is meant also to be explanatory of the method of my invention. The printing ribbon 12 is first threaded from the payoff reel 10 to the takeup reel 14 along the predetermined path shown in FIG. 1, so as to be placed in superposition on the strip of material 18 passing over the platen 16.

The operation of the apparatus can be commenced as the motor drive unit 40 and the unshown heater within the type carrier 20 are electrically turned on by activation of the respective switches, not shown, that may be mounted on either side panel of the casing 28. It is understood that the strip of material 18 starts traveling rightward over the platen 16 simultaneously as the type carrier 20 is set in counterclockwise rotation by the motor drive unit 40. The type 22 on the type carrier 20 is thus revolved about the axis parallel to the rotational axis of the platen 16 at speed synchronous with the speed of the strip of material 18 and in the direction conforming with its direction of travel.

The heated type 22 on the rotating type carrier 20 is then pressed against the printing ribbon 12 on the strip of material 18 passing over the platen 16. While the heated type is being pressed against the printing ribbon, this ribbon is transported the predetermined distance with the strip of material relative to the platen, and in the meantime the character or characters on the typeface are imprinted on the strip. The platen 16 is of course rotated clockwise only while the type is being pressed against same via the superposed ribbon and strip.

Upon transportation of the printing ribbon 12 in the reverse direction, the pullback lever 24 is turned clockwise about the pivot pin 48 against the bias of the spring 50. When the printing ribbon is subsequently released by the type, the pullback lever is spring returned to its normal angular position to pull back the printing ribbon the same distance past the platen 16, while the strip of material 18 is allowed to continue traveling rightward at constant speed.

Then, while the type 22 is revolving out of contact with the printing ribbon 12, the drawoff roller actuating means functions to rotate the unitary drawoff roller 58 through the predetermined angle corresponding to the width of the character or characters on the typeface. This drawoff roller coacts with the drawoff roller halves 56*a* and 56*b* to feed just the required length of the printing ribbon toward the takeup reel 14. Since the rotation of the drawoff roller 58 is imparted to the takeup reel via the endless belt 86, the required length of the printing ribbon can be wound up onto this reel. Concurrently with the winding-up of the used printing ribbon onto the takeup reel, a fresh length of the ribbon is placed in superposition on the strip of material 18 over the platen 16 by being fed from the payoff reel.

By the repetition of the foregoing cycle of operation, the character or characters on the typeface are imprinted on the continuous strip of plastics or other material 18 at constant spacings. The printing ribbon 12 can be used absolutely wastelessly.

While I have shown and described what I believe to be the preferred embodiment of my invention, it is understood that the invention itself is not to be restricted by the exact showing of the drawings or the description thereof. For instance, in the method of my invention, the used printing ribbon may be wound up onto the takeup reel substantially simultaneously when the ribbon is pulled back toward the reel. Further in the apparatus of my invention, the rotary platen may be replaced by a stationary platen having a flat surface, with the type revolved about a fixed axis substantially parallel to the stationary platen surface. Still further, the pullback lever pivotally supported at its midpoint may be replaced by one pivotable about one of its ends and having an upstanding roller or rod on the other end.

These and various other modifications or variations which will readily occur to those skilled in the art are intended in the foregoing disclosure. It is therefore appropriate that my invention be construed broadly and in a manner consistent with the fair meaning or proper scope of the following claims.

I claim:

1. In hot stamping apparatus wherein heated type is pressed against a printing ribbon for imprinting characters on a continuous strip of material traveling in a predetermined direction over a platen at constant speed, the type having at least one relief character on its face, the combination of:

a. a support panel defining a ribbon travel path including thereon a rotatable payoff reel from which the printing ribbon is fed at one end of said defined travel path;

b. a rotatable takeup reel likewise supported by said panel at the other end of said defined travel path for accumulating the printing ribbon fed from said payoff reel, the printing ribbon traveling from said payoff reel to said takeup reel generally in a direction opposite to said predetermined direction and being placed in superposition on the strip of material over said platen;

c. a type carrier likewise supported by said support panel along said travel path between said payoff and takeup reels, having type fixedly mounted thereon and rotatable on said panel about a fixed axis over said platen, the type on said type carrier being adapted to be pressed against the printing ribbon on the strip of material over said platen;

d. drive means coupled to said type carrier for imparting rotation to said type carrier for revolving said type at speed synchronous with the speed of the strip of material and in a direction corresponding to said predetermined direction;

e. yieldable means supported on said panel between said takeup reel and said type carrier tending to hold an extra length of the printing ribbon between said platen and said takeup reel, whereby the printing ribbon is permitted to be transported a predetermined distance in said predetermined direction with the strip of material relative to said platen while being pressed by the type and, when subsequently released by the type, to return the same distance to said opposite direction relative to said platen; said yieldable means having: a pullback lever pivotally supported on said panel at a point intermediate both ends thereof, a pair of rollers rotatably mounted on both ends of said pullback lever, and, resilient means yieldably urging said pullback lever to a predetermined angular position, said pullback lever being angularly displaceable from said predetermined position against the force the force of said resilient means when the printing ribbon is transported in said predetermined direction relative to said platen;

f. takeup reel actuating means coupled to said takeup reel for causing said takeup reel to wind up a length of the printing ribbon corresponding to the width of the character on the typeface after each time the type has been pressed against the printing ribbon; and, g. drawoff means for drawing the successive desired lengths of the printing ribbon from between said platen and said type carrier coupled to said yieldable means and for feeding the printing ribbon toward said takeup reel, said drawoff means including: a pair of drawoff rollers with means urging said drawoff rollers against each other via the printing ribbon under sufficient pressure to hold the ribbon frictionally arrested therebetween when the ribbon is transported in said predetermined direction by the type, and drawoff roller actuating means including a drawoff roller shaft on one of said drawoff rollers for intermittently rotating said drawoff rollers through a predetermined angle in step with the rotation of said takeup reel, said drawoff roller actuating means also including: a cam coupled to and constantly rotated by said drive means, a cam follower mounted on said cam for translating the rotary motion of said cam into reciprocal motion, said cam follower having a free end with link means at said free end, a one-way clutch coupled to said link means, said one-way clutch being operatively connected to said drawing roller shaft transmitting the reciprocal motion of said cam follower to said one drawoff roller via said one-way clutch whereby said one drawoff roller is rotated only in such a direction that the printing ribbon is fed toward said takeup reel.

2. The hot stamping apparatus as recited in claim 1, wherein said takeup reel actuating means comprises means for imparting the intermittent rotation of said one drawoff roller to said takeup reel.

3. The hot stamping apparatus as recited in claim 1, wherein one of said drawoff rollers is transversely divided into a pair of axially spaced cylindrical halves, and wherein the apparatus further comprises:

a. a support member having a hole extending therethrough in a direction parallel to the rotational axis of the other of said drawoff rollers, said support member being adapted to be yieldably urged toward said other drawoff roller by said urging means;

b. a spindle extending through said hole in said support member with substantial clearance, said drawoff roller halves being rotatably mounted on said spindle and being disposed on opposite sides of said support member; and c. means connecting said spindle, at a midpoint between said drawoff roller halves thereon, to said support member in such a manner that said spindle is slightly pivotable about the midpoint relative to said support member in a plane containing the rotational axis of said other drawoff roller, whereby said drawoff roller halves are urged against said other drawoff roller via the printing ribbon under equal pressure.

4. The hot stamping apparatus as recited in claim 3, wherein said connecting means is a set screw.

* * * * *